US005466981A

United States Patent [19]

Fields et al.

[11] Patent Number: 5,466,981

[45] Date of Patent: Nov. 14, 1995

[54] INTEGRAL REFLECTOR LAMP

[75] Inventors: Larry R. Fields, Richmond, Ky.; Jerald D. Will, Bath, N.Y.; Mark S. Rense, Richmond, Ky.

[73] Assignee: Philips Electronics North America Corporation, New York, N.Y.

[21] Appl. No.: 269,975

[22] Filed: Jul. 1, 1994

Related U.S. Application Data

[63] Continuation of Ser. No. 129,793, Sep. 30, 1993, abandoned, which is a continuation of Ser. No. 629,880, Dec. 19, 1990, abandoned.

[51] Int. Cl.[6] ..... H01J 17/18; H01J 61/34

[52] U.S. Cl. ..... 313/113; 313/25; 313/318.11; 362/306

[58] Field of Search ..... 313/113, 25, 318.11; 362/304, 306, 347

[56] References Cited

U.S. PATENT DOCUMENTS 4,480,212 10/1984 Monahan et al. ..... 313/113 X
4,564,783 1/1986 Krieg et al. ..... 313/113
4,663,558 5/1987 Endo ..... 313/113 X
4,829,210 5/1989 Benson et al. ..... 313/113 X

*Primary Examiner*—Sandra L. O'Shea
*Assistant Examiner*—Matthew J. Esserman
*Attorney, Agent, or Firm*—Edward Blocker

[57] ABSTRACT

An electric lamp is provided which includes a reflector typically made of glass or metal and having a reflecting surface in which an area is formed to fit a locating device attached to the internal capsule light source. At the rear of the reflector is a neck portion in which are located several seating points for the light capsule locating device. Electrical connectors extend between the capsule and the base member. The positioning member is definitely located by seating ledges molded into the neck of the reflector. In manufacture, the positioning member is placed in tension and the lead wires for the lamp assembly extend through eyelets in the base which are then mechanically fastened so as to maintain a tension on the positioning member. The fact that the positioning member is under tension allows it to maintain positional accuracy during the life of the lamp.

10 Claims, 1 Drawing Sheet

INTEGRAL REFLECTOR LAMP

This is a continuation under 37 C.F.R. 1.53 of application Ser. No. 08/129,793, filed Sep. 30, 1993, now abandoned, which is a continuation of application Ser. No. 07/629,880, filed Dec. 19, 1990, now abandoned.

BACKGROUND OF THE INVENTION

This application relates to an integral reflector lamp having improved light output efficiency with better control of light output distribution, improved light source alignment, increased shock resistance, internal heat shielding and heat transfer, and more accurate yet simplified manufacturing methods.

The design of reflectors used with lamps having medium sized screw bases has not changed since the inception of incandescent parabolic lamps. Due to limitations in glass production technology, a certain size area had to be lost in the back of the reflector. These limitations included the necessity that the glass thickness be uniform over the reflector body and that draft angles allow for easy release of glass pressing tools. Points of contact for internal lead-in wires (ferrules) were placed into the glass so that the widest possible spacing was achieved to allow the use of the longest filament and bridge mechanism possible. Filaments were mounted perpendicular to the reflector axis and were made as long as possible to increase stability and shock resistance. Bases were designed to match up to the spacing of the filaments and the ferrules. When halogen capsules began to be used as internal light sources instead of the bare coil assemblies few changes were made in the reflector design to take advantage of this new technology. Assemblies employing capsules were designed to be mounted to fit the old spacings used in incandescent lamps even though the most widely used base type for operation at line voltage in the United States was the medium screw base whose design could not take advantage of such wide lead-in spacings. The area of the reflector section missing at the rear of the reflector remained the same even though such a large area was no longer required to accommodate the light source.

Methods of lamp production have also remained the same based on those used to make incandescent lamps. Internal light source alignment and filament location were controlled by referencing to the ferrules and the ends of the internal lead-in wires that contacted the ferrules. Tolerances on ferrule length and depth of insertion into the glass at the rear of the reflector were wide. Some manufacturers devised methods to focus the internal light source before the assembly was brazed into the ferrules thus adding time and cost to the manufacturing process. Due to the use of these inaccurate methods, beam intensity and beam pattern could vary greatly from lamp to lamp. In addition, such assemblies were susceptible to shock during manufacturing, shipping, or operation since the internal light source could change position and therefore change the photometric properties of the lamp. Since all capsule support was supplied through the internal lead-in wires, shock could also cause lamp failure due to breakage of welds, the internal capsule light source itself, or the filament.

U.S. Pat. No. 4,829,210 issued May 9, 1989 is directed to a reflector lamp including a light source capsule. The capsule is mounted within the neck of the lamp by a bowl shaped member which is a friction fit within the neck of the lamp. However, positioning of the lamp capsule is dependent upon the accuracy of the dimensions of the neck and positioning member which may be difficult to control in large volume manufacture. Furthermore, a friction fit is subject to loosening because of physical or thermal shocks and subsequent dimensional changes over the life of the lamp. The present invention is directed to overcoming these difficulties.

The invention disclosed here provides for easy, efficient alignment and corresponding production methods, improved lamp output efficiency and control of beam distribution, improved shock resistance, and internal heat shielding. Additional reflector surface is provided in the critical neck area of the reflector where limitations in glass pressing technology have resulted in a large hole.

SUMMARY OF THE INVENTION

In view of the foregoing, it is the object of this invention to provide an improved lamp construction which overcomes the limitations of pressed glass production methods and takes advantage of improved lamp manufacturing techniques.

A particular object of the invention is to provide a highly efficient light source using an internal capsule light source which is either an incandescent, tungsten halogen or arc discharge source mounted inside a reflector made of glass, ceramic, or metal to produce an integral reflector lamp having increased light output intensity and improved control of beam distribution. Increased efficiency and control of beam distribution results in reduced power requirements in all applications.

A further object is to provide as much useful reflecting surface as possible at the neck of the reflector where reflecting surface is most critical. This is particularly useful as lamps evolve to smaller and smaller package sizes requiring the same or better efficiency as larger lamps. As much as ten percent more reflecting surface can be added using the method described herein. The addition of a one millimeter wide area at the reflector neck increased the center beam candlepower by ten percent in one application. In addition, different reflector formulas may be used for the added surface to adapt the light output pattern to the particular application.

A further object is to provide a method for exact location of the light source, whether it is a filament or arc discharge, with respect to the main reflector contour while reducing manufacturing time and cost. Light source alignment is also assured throughout the manufacturing process and during the life of the lamp.

Another object of this invention is to provide a very stable lamp construction in which light source position cannot be altered by shock regardless of handling or the application in which the lamp is used.

A further object is to provide heat shielding for the lamp base and any other parts located behind the capsule light source.

These and other objects, advantages, and features are attained in accordance with the principle of this invention by providing a lamp with an efficient capsule light source located inside a reflector at the optimum position to produce the desired output pattern and illumination level. A base member is located to the reflector in such a way as to retain the preset illumination pattern and light output level.

In accordance with one aspect of the invention, an electric lamp is provided which includes a reflector typically made of glass or metal and having a reflecting surface in which an area is formed to fit to a positioning device attached to the internal capsule light source. At the rear of the reflector is a neck portion in which are located several seating points for the lighting capsule locating device. Electrical connectors extend between the capsule and the base member. The positioning member is definitely located by the seating points molded into the neck of the reflector. In manufacture the positioning member is placed in tension and the lead wires for the lamp assembly extend through eyelets in the base which are then crimped and welded so as to maintain a tension on the positioning member. The fact that the positioning member is under tension will maintain positional accuracy during the life of the lamp.

BRIEF DESCRIPTION OF THE DRAWINGS

For a better understanding of the invention reference is made to the following drawings which are to be taken in conjunction with the detailed specification to follow.

DETAILED DESCRIPTION OF THE PREFERRED EMBODIMENTS

Figure 1:
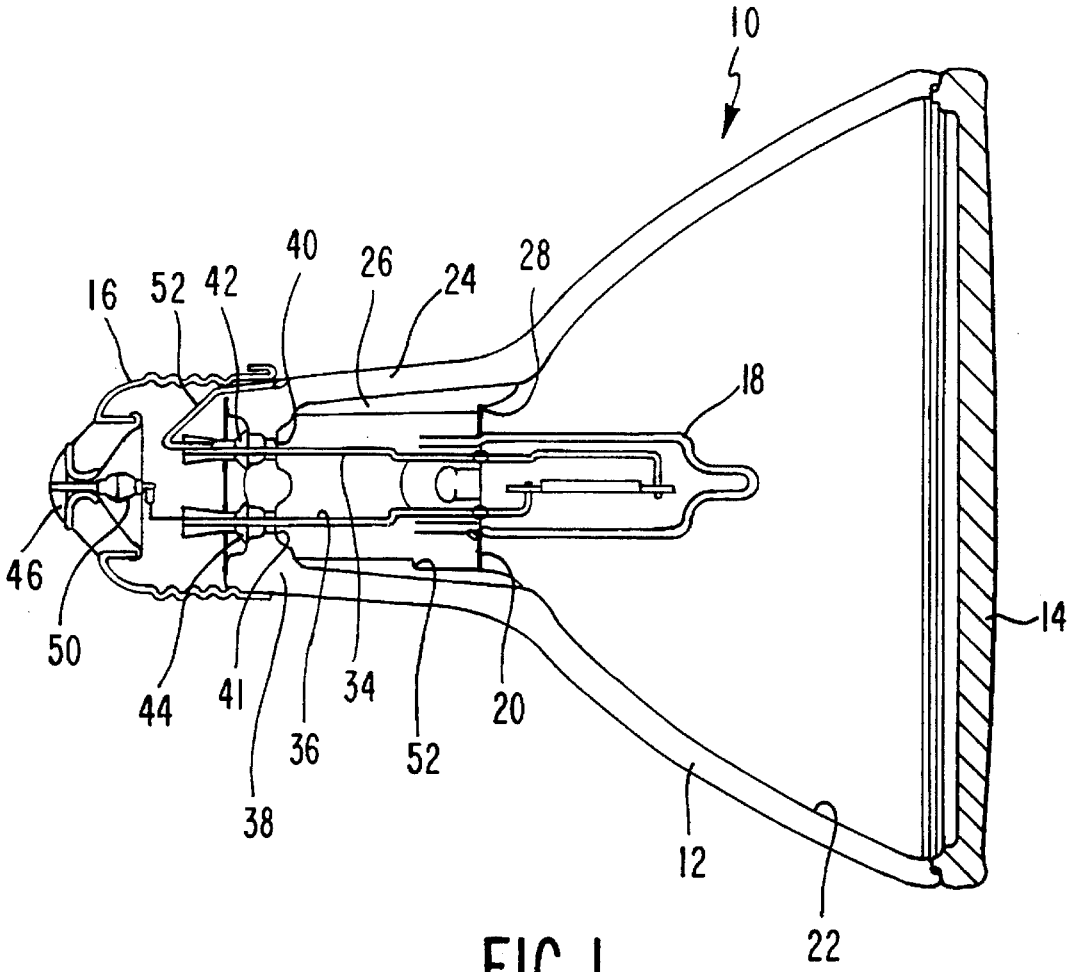
FIG. 1 is a section view of a reflector lamp constructed in accordance with the instant invention.

The drawings illustrate a reflector lamp 10 which includes a reflector housing 12, a lens 14 and a base 16 for electrical connection. Mounted within housing 12 is a light source 18 mounted by means of a positioning member 20 which is described in detail below. As is well known, lens 14 may be separate from reflector housing 10 as illustrated in FIG. 1 or be cast integrally therewith. The interior surface 22 of the forward reflector portion of lamp housing 10 contains a suitable reflective or dichroic coating. Base 16 may be of the standard screw-in Edison type, as illustrated, or any of the other type of lamp bases.

Figure 2:
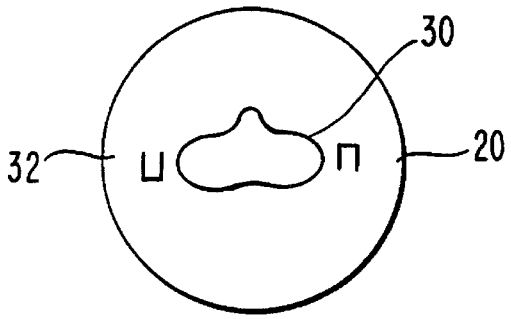
FIG. 2 is a plan view of the positioning member which is inserted into the reflector lamp to hold the light source.

The neck portion 24 of lamp housing 12 includes two or more protrusions 26 which have a ledge portion 28 for seating positioning member 20. As is shown in FIG. 2, positioning member 20 includes an opening 30 for receiving lamp element 18. Additionally, positioning member 20 includes tabs 32 for engaging the sides of light source 18. Extending from the base end of light source 18 are conductive leads 34, 36 which serve to provide electrical connection from light source 18 to base 16. The rearward end of lamp housing 12 includes a narrowed neck portion 38 which is disposed within the upper portion of base 16. Portion 38 of lamp housing 10 includes openings 40, 41 for receiving leads 34, 36. Lead 34 extends through opening 40 and a metallic eyelet 42 disposed behind opening 40. Similarly lead 36 extends through opening 41 and through a metallic eyelet 44. Lead 36 is connected to the tip 46 of base 16 through a diode 50. Lead 34 is joined to the threaded portion of base 16 by means of a ground lead 52.

During assembly of lamp 10, light source 18 is inserted in opening 30 of positioning member 20 which is placed in engagement with ledge 28 of protrusion 26. Thereafter, 10–12 pounds of force is applied to positioning member 20 so as to deform it slightly rearwardly. After the force is applied to positioning member 20 eyelets 42, 44 are then mechanically fastened (i.e. crimped and welded) to leads 36, 40 which will retain the deformation of positioning member 20. After a period of time the assembly will "relax" so that approximately 5 pounds of force remains on positioning member 30. However, this is sufficient to maintain positioning member 20 in firm engagement which with seating ledge 28 so as to maintain proper positioning of light source 18 with respect to lamp housing 12. Such positioning will remain intact even through mechanical and thermal shock.

Positioning member 20 is preferably manufactured from stainless steel of about 0.015 to 0.018 inches in thickness which provides sufficient strength at high temperatures. Positioning member 20 is also coated with vapor deposited aluminum so as to prevent tarnishing and insure that radiant energy is reflected forward throughout the life of the lamp and to provide a heat shielding function. Protrusions 26 may include additional seating ledges 54 to accomodate different sizes of positioning members and light sources.

The present application has been described in conjunction with preferred embodiments. However it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A reflector lamp comprising:

a reflector housing, having a reflector portion and a neck portion, said neck portion including seating means disposed at a predetermined location;

a base joined to said reflector housing for mounting to an external fixture;

a light source element having leads extending rearwardly therefrom for electrical connection to said base;

a positioning member, constructed of deformable material, for mounting said light source element within said reflector housing, said positioning member having an opening for receiving said light source element, said positioning member being received by said seating means of said housing; and said housing further including means for holding said electrical leads of said light source element under tension so as to deform said positioning member and hold same in engagement with said seating means to position said positioning member and said light source element within said reflector housing.

2. The reflector lamp as claimed in claim 1 wherein said positioning member has a reflective surface for reflecting light and heat.

3. The reflector lamp as claimed in claim 1 wherein said positioning member comprises a generally planar metallic element.

4. A reflector lamp as claimed in claim 3 wherein said positioning member comprises steel having a thickness of 0.015 to 0.018 inches.

5. A reflector lamp as claimed in claim 1 wherein said neck portion of said reflector housing includes multiple seating means for seating said positioning member at different locations therewithin.

6. A lamp reflector comprising:

a housing, having a neck portion, said neck portion including seating means disposed at a predetermined location;

a base joined to said housing for mounting to an external fixture;

a light source element having leads extending rearwardly therefrom for electrical connection to said base;

a positioning member, constructed of deformable material, for mounting said light source element within said housing, said positioning member having an opening for receiving said light source element, said positioning member being received by said seating means of said housing; and said housing further including means for holding said electrical leads of said light source element under tension so as to deform said positioning member and hold same in engagement with said seating means to position said positioning member and said light source element within said housing.

7. The reflector lamp as claimed in claim 6 wherein said positioning member has a reflective surface for reflecting light and heat.

8. The reflector lamp as claimed in claim 6 wherein said positioning member comprises a generally planar metallic element.

9. A reflector lamp as claimed in claim 8 wherein said positioning member comprises steel having a thickness of 0.015 to 0.018 inches.

10. A reflector lamp as claimed in claim 6, wherein said neck portion of said housing includes multiple seating means for seating said positioning member at different locations therewithin.

* * * * *